United States Patent [19]

Yoshinaga et al.

[11] Patent Number: 4,593,992

[45] Date of Patent: Jun. 10, 1986

[54] IMAGE FORMING APPARATUS

[75] Inventors: Kenji Yoshinaga, Yokohama; Yusaku Takada, Tokyo, both of Japan

[73] Assignee: Canon Kabushiki Kaisha, Tokyo, Japan

[21] Appl. No.: 644,561

[22] Filed: Aug. 27, 1984

[30] Foreign Application Priority Data

Aug. 31, 1983 [JP] Japan ..... 58-159654

[51] Int. Cl.[4] ..... G03G 15/09

[52] U.S. Cl. ..... 355/3 FU; 355/14 FU; 219/216

[58] Field of Search ..... 355/3 FU, 14 FU, 15; 219/216

[56] References Cited

U.S. PATENT DOCUMENTS

| | | | |
|---|---|---|---|
| 4,192,229 | 3/1980 | Tsunoi et al. | 355/3 FU X |
| 4,272,666 | 6/1981 | Collin | 355/3 FU X |
| 4,341,458 | 7/1982 | Glasa et al. | 355/3 FU |
| 4,385,826 | 5/1983 | Itoh | 355/14 FU |
| 4,391,509 | 7/1983 | Cavagnaro | 355/14 FU |
| 4,429,990 | 2/1984 | Tamary | 355/14 FU |
| 4,496,234 | 1/1985 | Schram | 355/14 FU X |

*Primary Examiner*—A. C. Prescott

*Attorney, Agent, or Firm*—Fitzpatrick, Cella, Harper & Scinto

[57] ABSTRACT

An image forming apparatus for forming an unfixed image on a recording material includes a fixing device having a pair of rotatable members for holding therebetween and conveying the recording material to fix the unfixed image on the recording material, speed control device for variably controlling the fixing rotational speed of the pair of rotatable members to a first fixing speed and a second fixing speed lower than the first fixing speed, application apparatus for intermittently supplying a parting agent to at least one of the pair of rotatable members, and application control apparatus for variably controlling the application acting period of the application apparatus in accordance with the fixing rotational speed of the pair of rotatable members variably set by the speed control device.

23 Claims, 7 Drawing Figures

IMAGE FORMING APPARATUS

BACKGROUND OF THE INVENTION

1. Field of the Invention

This invention relates to an image forming apparatus for forming unfixed images, fixing the unfixed images on a recording material and thereby providing desired images. As typical examples of such apparatus, there are printers, electrophotographic copying apparatus, facsimile apparatus, laser beam printers, etc., but in any of these apparatuses, there is provided a fixing rotatable member (a belt, a roller or the like) for fixing unfixed images by heating, heating and pressing or pressure.

2. Description of the Prior Art

Generally, a contact type fixing rotatable member is often used to efficiently fix unfixed images, and at the same time application of a parting agent for preventing offset is requisite.

Taking an ordinary electrophotographic apparatus as an example, the amount of parting agent applied should preferably be slight and uniform for monochromatic images. In the case of multi-colored images where the type of the recording material is varied or the amount of toner constituting the image is increased, it would occur to mind to slow down the fixing speed to improve the fixation, but since the rate at which offset occurs increases, the amount of parting agent applied should preferably be relatively great.

However, applying a relatively great amount of parting agent at all times may result in wasteful loss of the parting agent during non-fixation and therefore, it is preferable to control the supply of the parting agent so that the parting agent is supplied intermittently.

On the other hand, the intermittent, supply of the parting agent which has heretofore been proposed and practised is effected for a predetermined period in an image forming apparatus wherein the fixing speed is constant. Conversely, in most of the conventional apparatuses, the supply the parting agent is continued at all times.

However, in a case where a relatively great amount of parting agent is required as described above, if the fixing speed or the fixing effectiveness is varied for other purposes, for example, in a fixing device provided with fixing rollers, the time required for the parting agent to come from the location at which the parting agent is applied to the location at which the rollers contact the recording material to fix the image thereon, i.e., the nip between the rollers, will differ. Also, the circumferential length of the roller in the area of the roller surface to which the parting agent is applied is varied by the speed difference and the dimensions of that area are varied. Because of these problems, the area of the roller surface to which the parting agent is actually applied has not become a desired one. Further, because of the difference in the arrival time of the parting agent, there occurs a deviation between the period when the area of the roller surface to which the parting agent has been applied passes through the nip and the period when the recording material passes through the nip. Also, the dimensions of the area of the roller surface to which the parting agent has been applied are varied and particularly, if a second fixing speed is lower than a first fixing speed, the dimensions of said area are reduced and cannot cover the size of the recording material.

Thus, in the conventional image forming apparatus, if the fixing speed is changed, the roller surface to which the parting agent is not applied may sometimes be brought into contact with the toner on the recording material, and this may give rise to the problem of offset. Also, the parting agent on the area of the roller surface which has not contacted the recording material is wasted, and this is not only uneconomical but also may cause the environment to be stained. Further, if the parting agent is not supplied to the roller surface corresponding to the leading end portion of the recording material, the recording material may twine around the roller surface, thus causing jam.

These problems were not known because an apparatus in which the fixing speed was varied and the application of the parting agent was intermittently inventor has now recognized these problems.

SUMMARY OF THE INVENTION

It is an object of the present invention to solve the above-noted problems and to provide an image forming apparatus in which even if the speed of fixing rotatable members is variably controlled, a parting agent is reliably supplied to the portion of the surface of the rotatable members which is opposed to the recording material, particularly the leading end portion of the recording material, to thereby decrease offset and also prevent twining of the recording material.

It is another object of the present invention to provide a color image forming apparatus in which an unfixed image is made into a multi-colored image and even if an extremely low fixing speed is adopted when the image is heated and fixed on a film such as a resin sheet different from the ordinary recording material, occurrence of offset can be greatly prevented and clear images excellent in color mixing property can be obtained.

Other objects of the present invention will become apparent from the following detailed description taken in conjunction with the accompanying drawings.

DESCRIPTION OF THE PREFERRED EMBODIMENT

Figure 1:
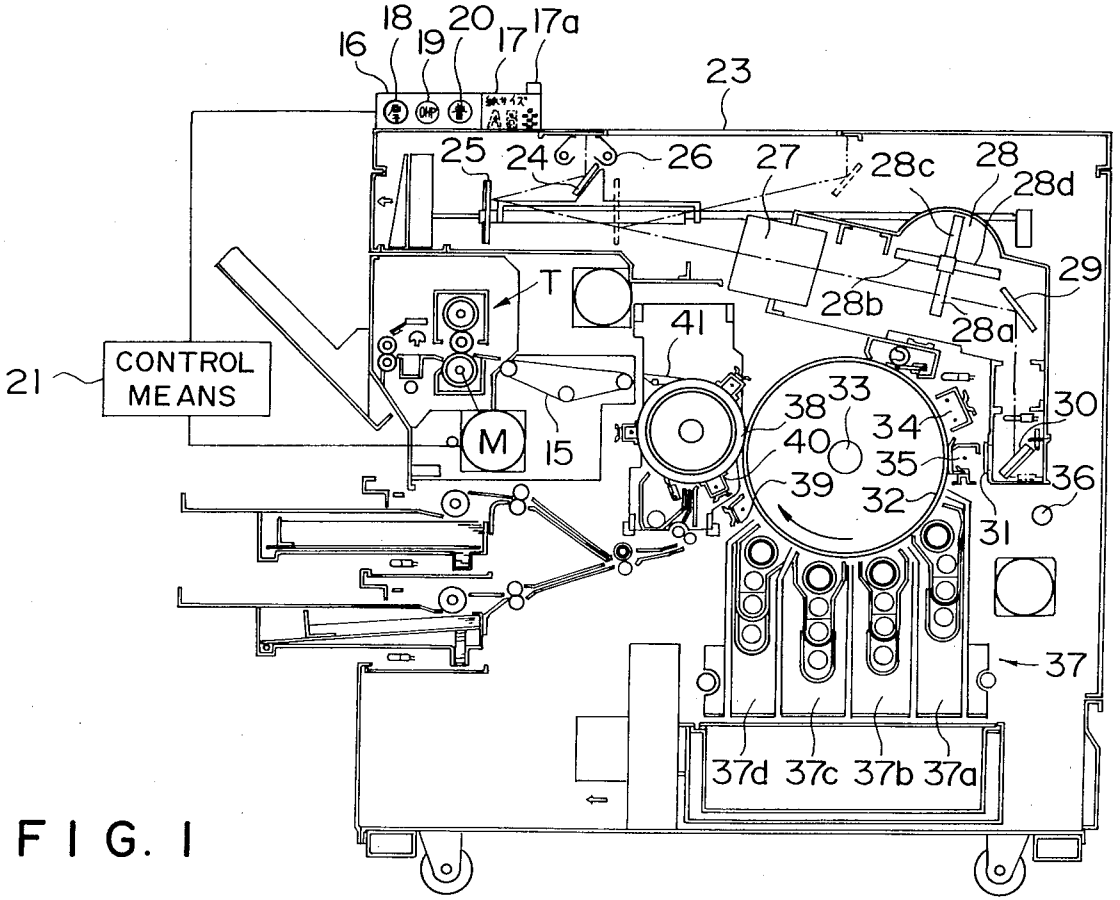
FIG. 1 is a schematic illustration of a color copying apparatus to which the present invention is applied.

The example hereinafter described is one in which the present invention is applied to a color electrophotographic apparatus, whereas the present invention is not restricted thereto but the technical idea of the present invention is applicable generally to image forming apparatus.

The apparatus of FIG. 1 will first be described briefly.

An original (not shown) on an original carriage glass 23 is irradiated by illuminating means 26 (an iodine lamp and a reflector) formed integrally with a first scanning mirror 24 and is scanned by the first scanning mirror 24 and a second scanning mirror 25. The first and second scanning mirrors are moved at a speed ratio of 1:½ to thereby scan the original while always keeping a first half of the optical path length of a lens 27 constant.

The reflected light image passes through the lens 27 to a color resolving filter 28 and the light image is color resolved by one of color filters 28*a*, 28*b* and 28*c* corresponding to three colors—red, green and blue, and the color-resolved light image is formed on a photosensitive drum 32 via a fixed third mirror 29, a forth mirror 30 and a dust-proof sealing glass 31. The photosensitive drum 32 is rotatably supported on a shaft 33, is rotated in the direction of the arrow in response to the operation of a copy button, is charged (for example, to the positive polarity) by a primary charger 34, and then is electrically discharged by an AC discharger 35 while the color-resolved light image is applied to the photosensitive drum, and the whole surface of the drum is uniformly irradiated by a whole surface exposure lamp 36 to obtain an electrostatic latent image of high contrast.

The electrostatic latent image on the photosensitive drum 32 is then developed into a visible image by a developing device 37. The developing device 37 is comprised of four developing means 37*a*, 37*b*, 37*c* and 37*d* for cyan, magenta, yellow and black, respectively, and the latent image is developed into a visible image by the developing means 37*c* corresponding to the color resolving filter (for example, the yellow developing means for the blue filter). Each developing means has a sleeve of non-magnetic material, a magnet and a developer agitating screw disposed in the sleeve. Thereafter, the dust powder image on the photosensitive drum after development is charged to a desired polarity by post-charger 22, whereafter it comes to an image transfer station.

Recording materials P are contained in a cassette 40 removably mounted to the apparatus body. In the present apparatus, two such cassettes are provided and contain recording materials of different sizes therein. When one of the upper and lower cassettes is selected by a selecting button 17*a* in the operating portion provided on the upper part of the apparatus body, the size and type of the recording materials in the selected cassette is detected (automatically or manually) and the result of the detection is displayed.

A display portion 17 represents the size of the recording materials by 7-segment digital display for displaying JIS A or B, and a display portion 16 represents the type of recording materials, i.e., the paper type or the resin type (OHP 19), or thick paper 18 or paper 20 of a thickness of the degree normally used. These signals are supplied to control means 21 and on the basis of such information, the control means 21 controls the peripheral speed of the roller of fixing means T to obtain appropriate fixing. Such control may be accomplished by varying the number of revolutions (r.p.m.) of a motor M or varying the gear ratio of the trasmission system from the motor M to the roller.

Now, the selected recording material P has its predetermined timing measured by a pair of register rollers and is fed in synchronism with the dust image on the photosensitive drum 32. At this time, the recording material P comes into contact with an image transfer roll 38 via a guide and subsequently is subjected to corona discharge of the same polarity as the polarity of a post-charger 39 from the back of the recording material P by an electrostatic attracting charge 40 and thus, the recording material P electrostatically adheres to the image transfer roll 38. The image transfer roll 38 comprises an elastic roll disposed on the outer periphery of a metal roll, and electrically conductive rubber wound on the outermost layer of the elastic roll, and is grounded. The recording material P electrostatically attracted to the image transfer roll 38 is urged against the photosensitive drum in synchronism with the dust powder image thereon and that image is transferred to the recording material P, and a yellow dust image is formed on the recording material.

A similar process is carried out by the use of the red and green filters, and exposure to light, development and image transfer are repeated in succession. The recording material P on the image transfer roll repeats image transfer three times while being electrostatically attracted to the image transfer roll. In the case of the present apparatus, the ratio of the diameter of the photosensitive drum to the diameter of the image transfer drum is 2:1 and moreover, the two drums are directly connected together by a gear and therefore, the synchronization between the two drums never gets out of order. Also, the color resolving filter 7 is changed to the next filter during the reversing process of the optical system, and the filter and the developing means corresponding thereto are endowed with a ratio of 1:1 by a program device.

Color resolution by the red, green and blue filters exposed to light, development by cyan, magenta and yellow toners and three superposition image transfers are effected as described above, whereafter a separating pawl 41 is operated by the program device to separate the electrostatically attracted recording material P from the image transfer roll 38, and the recording material P comes to the fixing means T via a conveyor belt 15.

Figure 2:
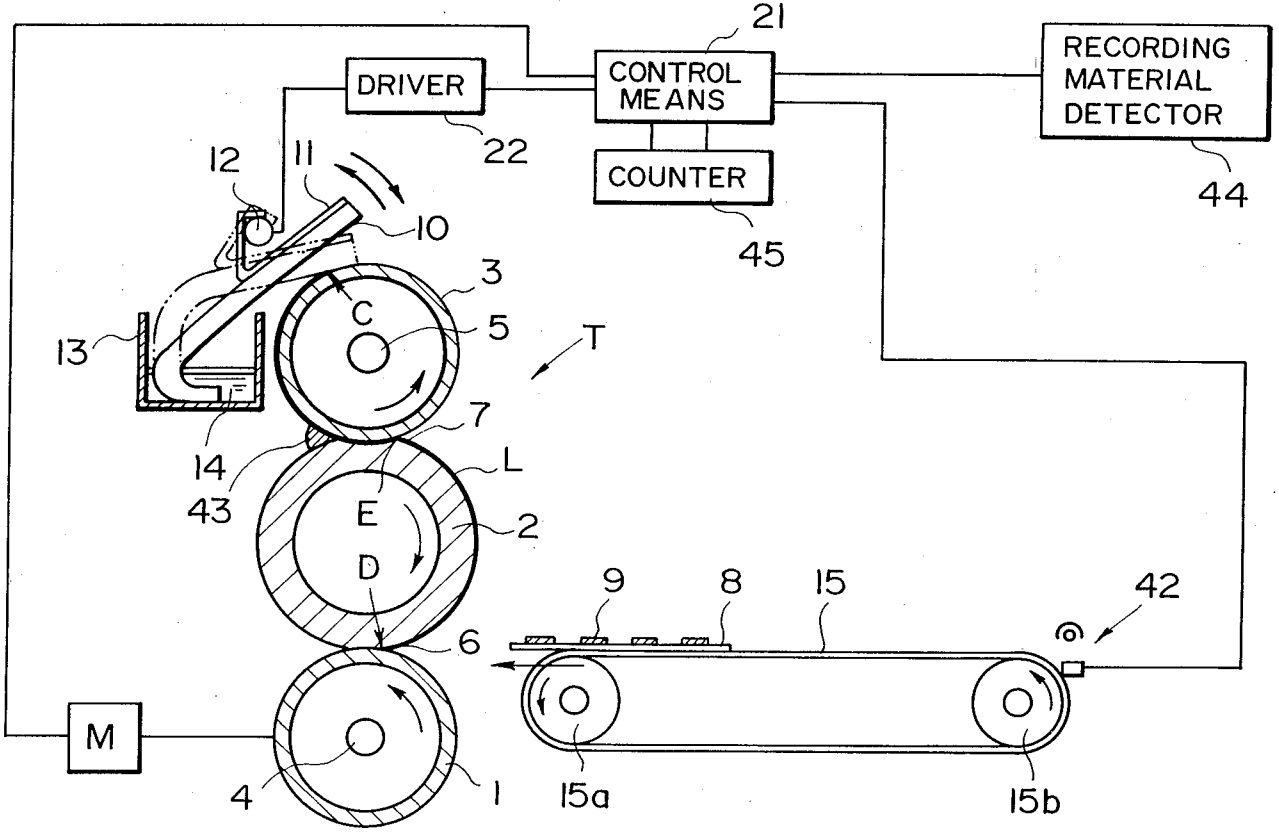
FIG. 2 is an enlarged view of the essential portions of FIG. 1 illustrating means for intermittently applying a parting agent, a fixing device of which the fixing speed is changeable and a conveying device.

FIG. 2 shows the construction of the fixing means T.

In the present example, the sequence control of the parting agent application relation is varied during the change of the fixing speed as shown in FIGS. 4 to 7 so that the surface of the roller to which the parting agent is not applied may not contact the toner image bearing surface of the recording material during the change of the fixing speed, and the parting agent is used effectively.

In the Figure, reference numerals 1 and 3 designate rollers having their surfaces coated with Teflon to provide a good parting property with respect to the toners, and a roller 2 disposed between these rollers 1 and 3 and rotated in contact therewith is designed to have a soft surface layer of silicon rubber. The rollers 1 and 3 are hollow and have heaters 4 and 5 inserted therein so as to be suitably heated thereby and accordingly, the silicon rubber 2 which is in contact with the two rollers is also indirectly heated and after all, the rollers 1, 2 and 3 plasticize by heat the thermoplastic toner 9 of the unfixed toner image on the recording material 8 inserted into and passed through the nip 6 between the rollers 1 and 2 and fuses the toner 9 to the recording material 8. Also, during the operation of the present apparatus, a load is imparted to the roller 3 in the direction toward the rollers 1 and 2 and the nips 6 and 7 between the rollers 1 and 2 and between the rollers 2 and 3 assume a surface-contact state with the silicon rubber layer of the roller 2 deformed by pressure.

Application felt 10 is adapted to suitably contact the surface of the roller 3 to apply a parting agent thereto. That is, the application felt 10 is lined and supported by a support plate 11 which is fixed to a rotatable shaft 12 rotatively driven by drive means 22. In the present embodiment design is made such that a parting agent is supplied to the roller 2 through the roller 3, and this is preferable, but alternatively design may be made such that the parting agent is supplied from the roller 1 to the roller 2 or that the application member acts on both of the rollers 1 and 2 to supply the parting agent thereto. The lower end of the application felt 10 is immersed in the silicon oil 14 in an oil pan 13 so that the silicon oil 14 permeates to the upper portion of the application felt 10 due to the capillary phenomenon. The rotatable shaft 12 is reciprocally rotatable in the directions of the arrows by being suitably given a rotational force by the drive means 22 operated by the electrical signal from the aforementioned control means 21, and the support plate 11 is pivoted with the rotatable shaft 12 to urge the application felt 10 against the surface of the roller 3 or space the application felt 10 apart from the surface of the roller 3. During this urging, the silicon oil 14 with which the application felt 10 is impregnated is applied to the surface of the roller 3 (at this time, the roller 2 acts as an application roller) and this silicon oil adheres to the rollers 2 and 1 in succession to prevent the offset of the toner.

The control means 21 controls the revolution of the motor M in accordance with the signal from recording material detecting means 44 (which discriminates the recording material by the utilization, for example, of a cassette signal, a light transmission signal or the like) for detecting the size, type and thickness of the recording material and variably controls the peripheral speeds of the rollers 1, 2 and 3 to a first fixing speed or a second fixing speed lower than the first fixing speed to obtain appropriate fixing. Consequently, the rollers, 1, 2 and 3 are maintained at speeds suitable for the recording material. Thereafter, when the thus detected recording material is detected by recording material passage detecting means provided at a predetermined position on this side of the fixing means T, the signal resulting from the detection is supplied to the control means 21. In correspondence with the generation period of this detection signal, the application period during which the application felt 10 bears against the roller 3 rotating at a fixing speed suitable for the recording material to apply a parting agent to the roller 3 is variably controlled by the control means 21. If the point of contact between the application felt 10 and the roller 3 is a point C and the starting point of the urged portion 6 of the rollers 1 and 2 is a point D, the silicon oil which is the parting agent moves at a given fixing speed over a distance L of arcs $\widehat{CE}+\widehat{ED}$ by the peripheral surfaces of the rollers 3 and 2 being rotated. Point E is the point at which the curvatures of the rollers 2 and 3 are varied. By varying the fixing speed, the time during which the silicon oil moves over the distance L is also varied and therefore, the application period is controlled to a different period for each fixing speed. This timing will later be described in detail by reference to FIGS. 4 to 6.

The conveyor belt 15 located on this side of the fixing means T in this embodiment is rotatively driven in counter-clockwise direction as viewed in FIG. 2 by conveyor rollers 15*a* and 15*b* rotated by drive means, not shown, and conveys to the nip 6 the recording material 8 to which an image has been transferred in the image transfer station of the image forming apparatus. This conveyance speed is constant independently of the fixing speed. As previously described, these rollers 1, 2 and 3 have their rotational speed variably controlled in response to the signal from the control means 21, but in the example described below, for the sake of simplicity, it is to be understood that the rotational speed is may be changed over to two set speeds, i.e., (a) a first fixing speed $V_1$ in the case of usually used paper and (b) a second fixing speed $V_2$ (smaller than the first fixing speed) in the case of thick paper or OHP (recording sheets of resin).

It is for the following reason that the rotational speed is so set. In the image fixing device as described above wherein the recording material is passed between a pair of rollers, if the type of the recording material varies, the amount of heat supplied to the toner on the recording material is varied by the degree of heat conduction and thickness of the recording material and thus, the fixed state is varied. That is, the image is not well fixed due to the difference in type of the recording material but may peel off. In addition, where a color copy image is to be obtained by a color copying apparatus, it is necessary to impart an appropriate amount of heat to toners of three primary colors in order to smoothly mix such toners to generate predetermined colors during fixation, but if the recording material varies as described above, a variation will occur to the colors of the color copy image. Further, where a color copy image is to be obtained on a Trapen film for OHP(overhead projection), the Trapen film is lower in heat conductivity than paper and therefore, it is necessary to impart a sufficient amount of heat to the Trapen film to cause toner to flow better to thereby flatten the toner layer so as to minimize the refraction and scattering of the projected light of OHP due to the ruggedness of the toner layer, but this cannot be realized by supplying the same amount of heat as in the case of paper. Accordingly, it is devised to change the fixing speed in order to cope with the variation in the amount of supplied heat by the variation in the recording material. This method intends to slow down the fixing speed for a recording material which is poor in heat conductivity or which requires a greater amount of heat, thereby increasing the of supplied heat per unit time.

Figure 3:
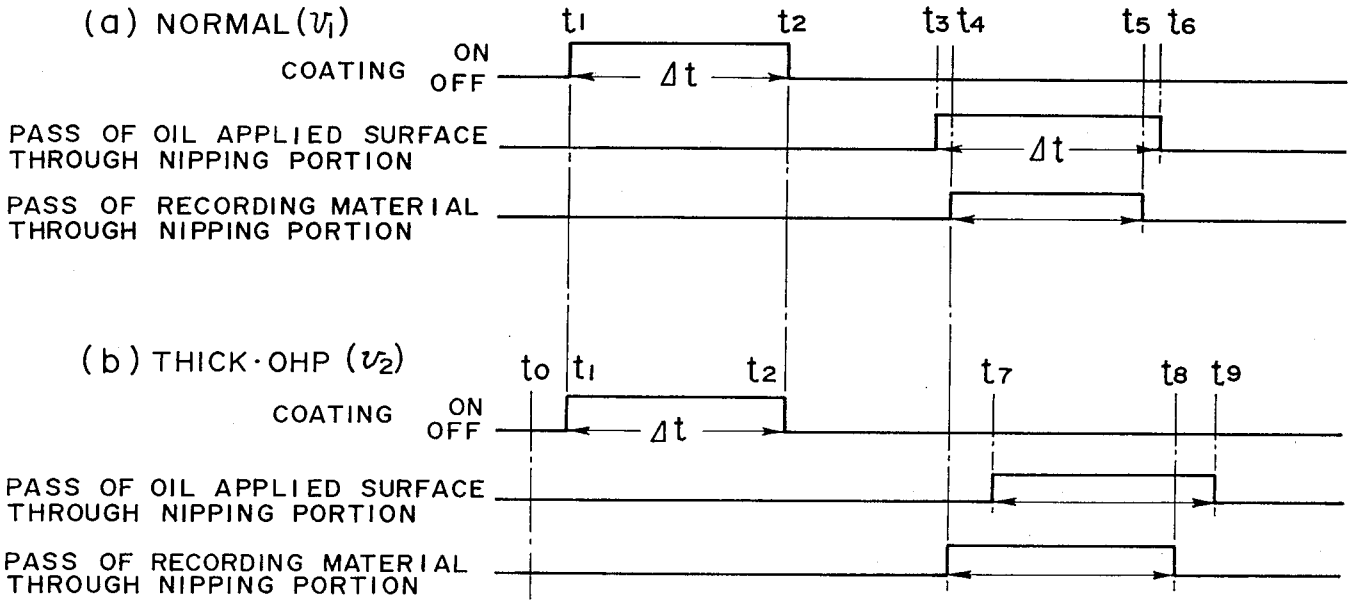
FIG. 3 illustrates a parting agent application sequence time chart (a) during a first fixing speed in a case where the present invention is not carried out and a parting agent application sequence time chart (b) during a second fixing speed used in the apparatus according to the prior art.

Reference is now had to FIG. 3 to describe the problem occurring in a case where the present invention is not used. It is to be understood that the size of the recording material remains unchanged in both (a) and (b) below.

In FIG. 3, time $t_1$ is the time when a rotational force is imparted to the rotatable shaft 12 and the application felt 10 comes into contact with the roller 3 and application of the silicon oil 14 is started, time $t_2$ is the time when the rotational force of the rotatable shaft 12 is cut off and the application felt 10 comes out of contact with the roller 3 and application of the silicon oil 14 is terminated, time $t_3$ is the time when the silicon oil 14 applied at the start of application comes to the nip 7 with the roller 3 rotating at the first fixing speed $V_1$ and transfers to the roller 2 and further enters the nip 6 with the rotation of the roller 2, time $t_4$ is the time when the recording material 8 enters the nip 6, time $t_5$ is the time when the trailing end edge of the recording material 8 passes through the nip 6, time $t_6$ is the time when the silicon oil 14 applied immediately before the application termination time $t_2$ passes through the nip 6 through the intermediary of the rotation of the roller 3 and the roller 2, time $t_7$ is the time when the silicon oil applied at time $t_1$ enters the nip 6 through the intermediary of the rotation of the rollers 3 and 2 rotating at the second fixing speed $V_2$, time $t_8$ is the time when the trailing end edge of the recording material 8 passes through the nip 6 at the second fixing speed $V_2$, time $t_9$ is the time when the silicon oil 14 applied immediately before the termination of application at time $t_2$ passes through the nip 6 through the intermediary of the rotation of the rollers 2 and 3 at the second fixing speed $V_2$, and time $t_{10}$ is the time when the rotational speed of the rollers 1, 2 and 3 is changed over to the second fixing speed $V_2$.

(a) First fixing speed $V_1$

At time $t_1$, a rotational force is imparted to the rotatable shaft 12 and the application felt 10 comes into contact with the roller 3, whereby the silicon oil 14 is applied till time $t_2$. In the meantime, the silicon oil 14 is applied in such a planar state that the part of the surface of the roller 3 to which the silicon oil has been applied at time $t_1$ is the fore end and the part of the surface of the roller 3 to which application of the silicon oil has been terminated at time $t_2$ is the rear end. The fore end of the surface to which the silicon oil has been applied moves to the nip 6 with the rotation of the roller 3 at the first fixing speed $V_1$. The silicon oil 14 in this portion transfers to the roller 2 at this nip 6 and further moves into the nip 6 at time $t_3$ with the rotation of the roller 2. The silicon oil rearward of the fore end of the surface to which the silicon oil has been applied also moves into the nip 6 and finally, the rear end of the surface to which the silicon oil has been applied enters the nip 6 at time $t_6$. In this case, the leading end edge of the recording material 8 begins to enter the nip 6 at time $t_4$ and the trailing end edge of the recording material 8 passes through the nip 6 at time $t_5$. Since $t_3<t_4$ and $t_5<t_6$, during the time that the recording material 8 is passing through the nip 6, the surface of the roller 2 which is opposed to the recording material 8 is the surface to which the silicon oil 14 has been applied and therefore, a parting action is exerted on the roller 2 and the toner 1 on the recording material 8 does not offset to the roller 2.

However, (b) if it is also assumed that also at the second fixing speed $V_2$, the same sequence control as the process condition at the first fixing speed $V_1$ is effected from the start of the copying operation till time $t_0$ and at time $t_0$, the rollers 1, 2 and 3 are changed to a rotational speed corresponding to the second fixing speed and are driven, the silicon oil 14 is applied from time $t_1$ till time $t_2$ as in the case of the first fixing speed $V_1$. As previously described, the surface of the roller 3 to which the silicon oil has been applied transfers to the roller 2 due to the rotation of the roller and further moves toward the nip 6. However, the rollers are being rotated at a rotational speed corresponding to the second fixing speed $V_2$ which is lower than the first fixing speed $V_1$ and therefore, the time when the fore end of the surface to which the silicon oil has been applied enters the nip 6 is later than time $t_3$ and is time $t_7$. Also, the rear end of the surface to which the silicon oil has been applied passes through the nip 6 at time $t_9$. On the other hand, the recording material 8 is conveyed by the conveying portion 20 at the same conveyance speed as that during the operation at the first fixing speed and therefore, it enters the nip 6 at time $t_4$. However, the roller is rotating more slowly than the first speed and therefore, it is at time $t_8$ later than time $t_5$ that the trailing end edge of the recording material 8 passes through the nip 6.

Accordingly, unlike the operation at the first fixing speed $V_1$, in the case of the second fixing speed $V_2$, $t_4<t_7$ and the surface of the roller 2 which is opposed to the recording material 8 passing through the nip 6 is not always the surface to which the silicon oil 14 has been applied. Particularly, the roller surface to which the silicon oil is not applied bears against the leading end portion of the recording material 8 and therefore, offset or twining of the recording material around the roller will occur.

As described above, in the apparatus wherein the fixing speed is varied by the type of the recording material, it is the principal aim to change the rotational speed of the rollers of the fixing device and the other conditions, particularly, the sequence control, is not varied. Accordingly, when the roller is rotated at the second fixing speed, as shown at time $t_4$ and $t_7$, the surface of the roller to which the parting agent has been applied is not opposed to the recording material during its passage through the nip so as to correspond to the recording material at the ratio of 1:1. As a result, the applied parting agent is not effectively used and a part of it is wasted. Particularly, in an image relatively easy to offset as compared with monochromatic copying as in the color image formation, the danger of offset is great. Accordingly, in spite of the fact that the parting agent is applied and consumed, the parting action of the parting agent cannot be given full play and this is very uneconomical. If the fixing speed is slowed down, the amount of rotation of the roller decreases and therefore, the distance between the fore end and the rear end of the surface of the roller to which the parting agent has been applied is shortened and the area of the surface to which the parting agent is applied becomes smaller. Therefore, the above-mentioned problem will occur depending on the size of the recording material.

Figure 4:
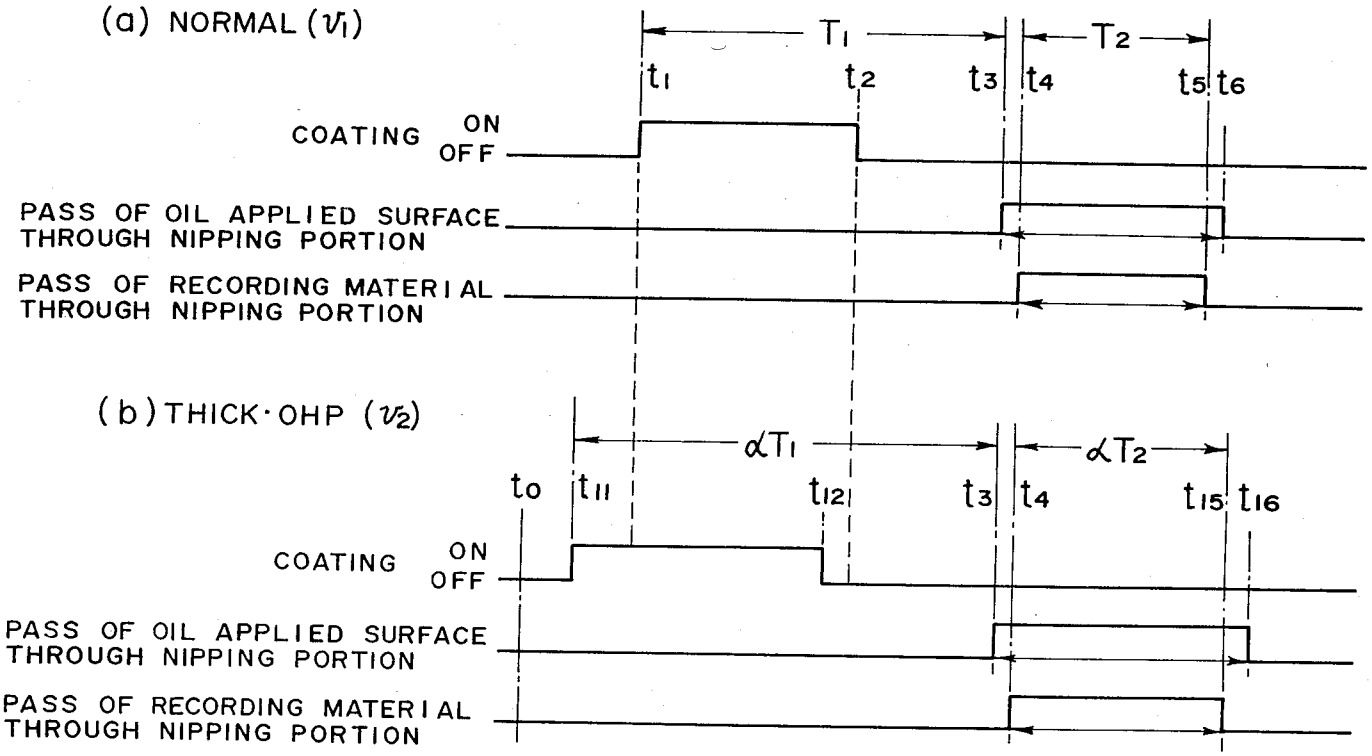
FIGS. 4, 5 and 7 illustrate embodiments showing a parting agent application sequence (a) during the first fixing speed of the present invention and a parting agent application sequence (b) during the second fixing speed.

FIG. 4 is a time chart showing the sequence control of the present invention, FIG. 3(*a*) is a time chart showing the sequence control at the first fixing speed and FIG. 3(b) is a time chart showing the sequence control at the second fixing speed. The mechanical construction of the fixing device is the same as that shown in FIG. 1.

The first fixing speed is the same as that shown in FIG. 3. Time $T_1$ is the time till the time $t_3$ when the parting agent applied at time $t_1$ moves with the rollers 3 and 2 and arrives at the nip 6. That is, in FIG. 1, $T_1=L/V_1$.

Time $t_{11}$ in the case of the second fixing speed $V_2$ is an application starting time corresponding to time $t_1$ and is earlier than time $t_1$. In the present embodiment, the time $t_3$ when the fore end of the surface of the roller 2 to which the silicon oil has been applied arrives at the nip is common for the speeds $V_1$ and $V_2$. Time $t_{12}$ represents the time when the application of the silicon oil at the second fixing speed is terminated, and gives the relations that time $(t_{12}-t_{11})$=time $(t_{16}-t_3)$, time$(t_{15}-t_4)<$time$(t_{16}-t_3)$ and $t_3<t_4$, where time $t_{15}$ corresponds to time $t_5$ and is the time when the trailing end edge of the recording material at the second fixing speed passes through the nip 6, and time $t_{16}$ corresponds to time $t_6$ and is the time when the rear end of the surface to which the silicon oil has been applied during the second fixing speed passes through the nip 6. Accordingly, in the present embodiment, $t_{16}>t_{15}$.

When by the use of a constant $\alpha$, there is the relation that $V_2=V_1/\alpha$ ($V_2<V_1$, $\alpha>1$) between the first fixing speed $V_1$ and the second fixing speed $V_2$, if it takes time $T_1$ at the first fixing speed for the silicon oil 14 applied to the roller 3 by the application felt 10 to arrive at the nip 6, time $\alpha T_1$ will be required at the second fixing speed. In the present embodiment, the application starting time $t_{11}$ is set time $\alpha T_1$ before time $t_3$ so that the fore end of the surface to which the silicon oil has been applied arrives at the nip 6 even at the second fixing speed at the same time as the time $t_3$ at the first fixing speed. Also, the time when the recording material 8 passes through the nip 6 is $\alpha T_2$ for the second fixing speed if it is $T_2$ for the first fixing speed. Accordingly, to maintain the surface of the roller 2 to which the silicon oil has been applied so as to contact the whole surface of the recording material 8 at the second fixing speed, the time $(t_{15}-t_4)-\alpha T_2$ during which the surface to which the oil has been applied passes through the nip 6 must be made correspondingly longer and for this purpose, the application time $(t_{12}-t_{11})$ is set to $(t_{12}-t_{11})\geqq\alpha T_2$.

If the oil application sequence is set as described above, the surface of the roller 2 to which the oil has been applied contacts the entire recording material 8 during both of the first and second fixing speeds even if the fixing speed of the roller varies and thus, there is no problem of offset. Describing the second fixing speed in detail, the silicon oil 14 applied at time $t_{11}$ enters the nip 6 at the same time $t_3$ as in the case of the first fixing sped via the time $\alpha T_1$. Accordingly, the leading end edge of the recording material 8 which begins to pass through the nip 6 at time $t_4$ comes into contact with the surface of the roller 2 to which the oil has been applied. On the other hand, the silicon oil 14 applied immediately before time $t_{12}$ when the application of the oil is terminated arrives at the nip 6 at time $t_{16}$ via the time $\alpha T_1$. The trailing end edge of the recording material 8 passes through the nip 6 at time $t_{15}$ earlier than time $t_{16}$. Thus, the whole surface of the recording material 8 comes into contact with the surface of the roller 2 to which the oil has been applied. In this manner, the other surface than the surface of the roller 2 to which the oil has been applied is prevented from coming into contact with the toner image on the recording material with the changeover of the fixing speed of the fixing device, whereby offset can be prevented.

Figure 5:
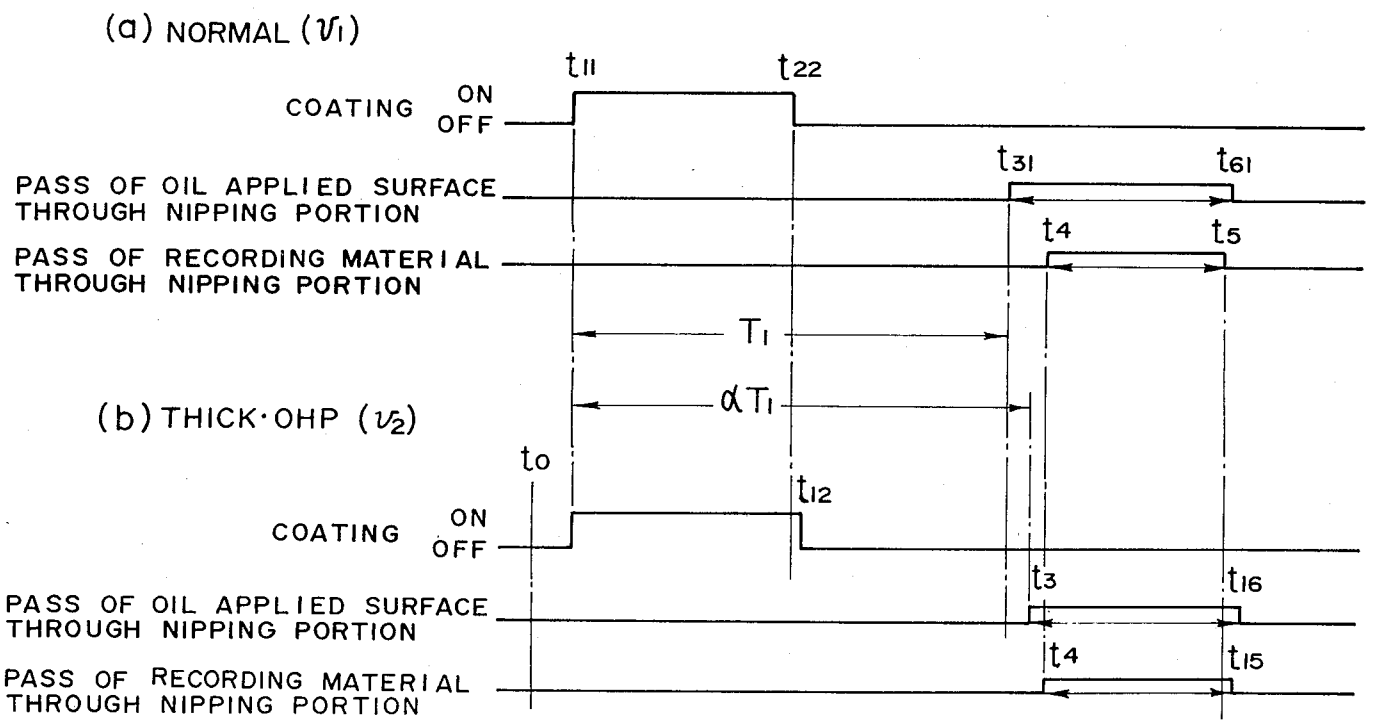

FIG. 5 shows another embodiment of the sequence control in which the timing chart of (a) normal speed $V_1$ of the embodiment of FIG. 4 is changed. A feature of this embodiment is that the application starting time $t_{11}$ remains unchanged during the first and second fixing speeds. In this case, in the sequence control, the control parameter is only the application termination time $t_{22}$ or $t_{12}$ and thus, when the program sequence control is to be effected, the program construction becomes simple and the memory capacity used may be small.

FIG. 5 has many portions common to FIG. 4 and can be simply understood by being compared with FIG. 4. As described in connection with FIG. 4, time $t_{11}$ ensures the leading end portion of the recording material at the second fixing speed to contact the surface of the roller to which the silicon oil has been applied. In FIG. 5, the time $t_1$ at the first fixing speed is changed to this time $t_1$ to quicken the start of the application of the silicon oil and only the application termination time $t_{22}$ is variably controlled in accordance with the length of the recording material. The time $t_{22}$ is set so that the time $t_{61}$ when the terminal end of the surface to which the oil has been applied passes through the nip is $t_5<t_{61}$.

Accordingly, time $t_{31}$ when the fore end of the surface to which the oil has been applied passes through the nip is earlier than time $t_3$ and satisfies $t_{31}=(t_{11}+T_1)$, and time $t_{22}$ is substantially equal to time $t_2$. As compared with the embodiment of FIG. 4, the period during which the oil is applied at the first fixing speed is increased by a time $(\alpha-1)T_1$, but since this fixing speed is higher than the second fixing speed, the amount of oil consumed is not so great and rather, the oil can be supplied to the surface of the roller 1 and thus, this is a preferable embodiment.

Figure 6:
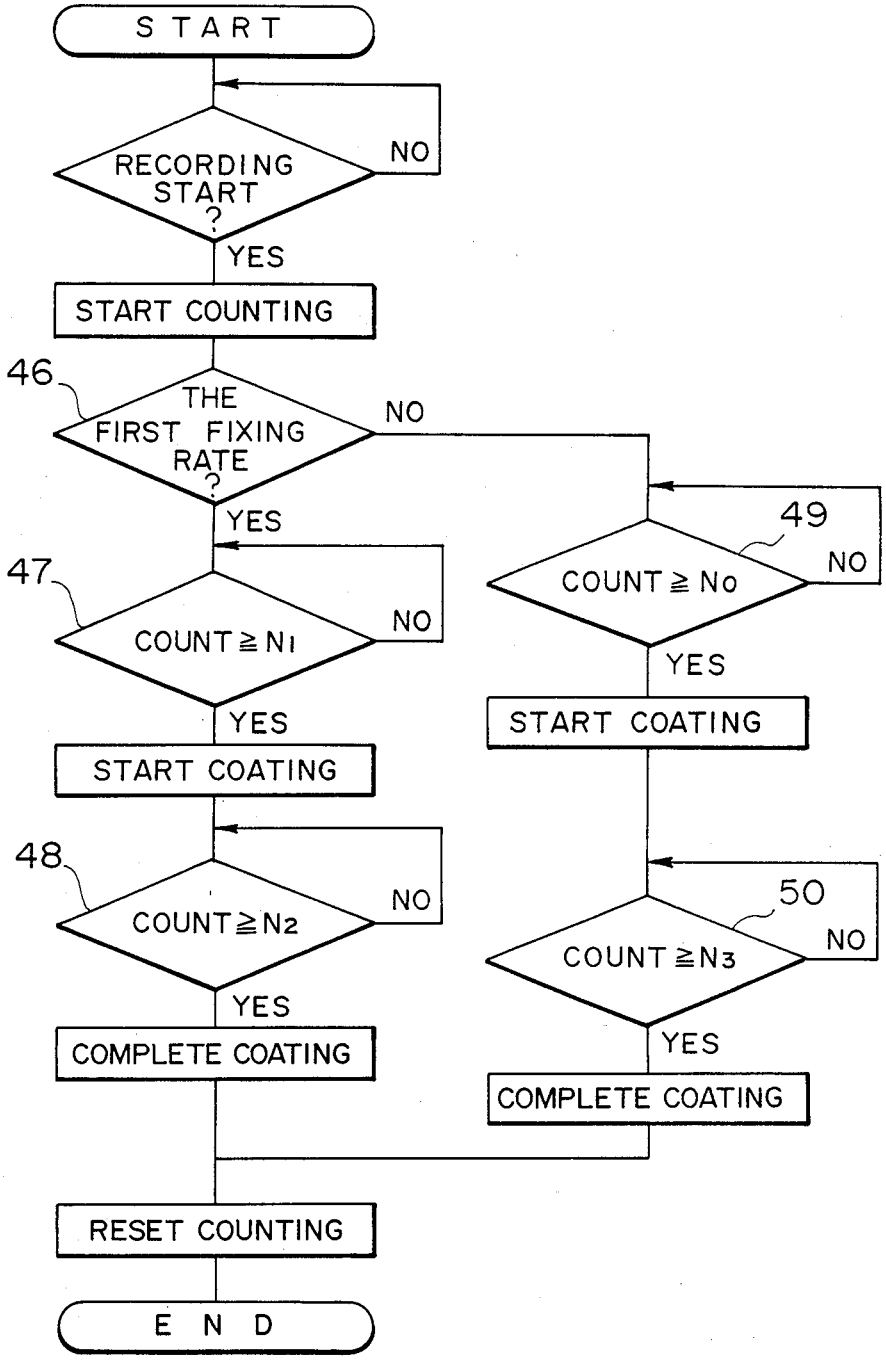
FIG. 6 is a flow chart for illustrating a further embodiment of the application sequence of the present invention.

FIG. 6 shows an example in which each time of the above-described timing chart is not determined on the basis of the direct detection of the recording material but is substituted for by the lapse time in the image formation process and is determined by indirectly grasping the movement of the recording material. It is to be understood that the construction is such that the application control by control means 21 is effected in accordance with the count value of the counter 45 shown in FIG. 2. As regards the counter 45, the angle of rotation of the photosensitive drum 32 or the image transfer roller 38 of FIG. 1 may be detected, or the pulse generated during the image formation such as clock pulse may be detected, or the detection such as the detection by the ordinary timer may be adopted.

Description will now be made on the basis of the flow chart. When recording is started, counting is started, and the fixing speed based on the recording material or other element is discriminated at judgment 46. At judgment 46, whether the fixing speed is the aforementioned first fixing speed is discriminated, and judgments 47 and 48 are effected in the mode of the first fixing speed and judgments 49 and 50 are effected in the mode of the second fixing speed. In any of the judgments, whether the count value has reached a predetermined value is judged. Predetermined values $N_0$, $N_1$, $N_2$ and $N_3$ are in the relations that $N_0\leqq N_1<N_2$ and $N_0<N_3$. The predetermined value $N_0$ corresponds to a time corresponding to the aforementioned time $t_{11}$ and causes the application of the oil in the second fixing speed mode to be started and ensures a relation such that a sufficient amount of silicon oil is applied to the surface of the roller when the leading end edge of the recording material enters the nip. Likewise, the predetermined value $N_1$ corresponds to a time corresponding to the aforementioned time $t_1$ or $t_{11}$ and causes the application of the oil in the first fixing speed mode to be started and ensures the above-described relation.

The predetermined value $N_3$ corresponds to a time corresponding to time $t_{16}$ and causes the application of the oil at the second fixing speed to be terminated and imparts a sufficient amount of silicon oil to the surface of the roller which bears against the trailing end edge of the recording material as it passes through the nip, and prevents any wasteful loss thereafter. Likewise, the predetermined value $N_2$ corresponds to a time corresponding to time $t_6$ or $t_{61}$ and effects an operation similar to that of the predetermined value $N_3$ in the first fixing speed mode.

Thereafter, when the image formation process is terminated, the count is reset and the preparation for the next process is made. Also, during the continuous copy mode, the application period may be determined so as to satisfy the above-described technical idea with the predetermined value $N_0$, $N_1$, $N_2$ and $N_3$, the image formation speed and the distance between the recording materials being taken into account. These predetermined values are of course determined so as to be changed depending on different sizes of the recording materials.

Figure 7:
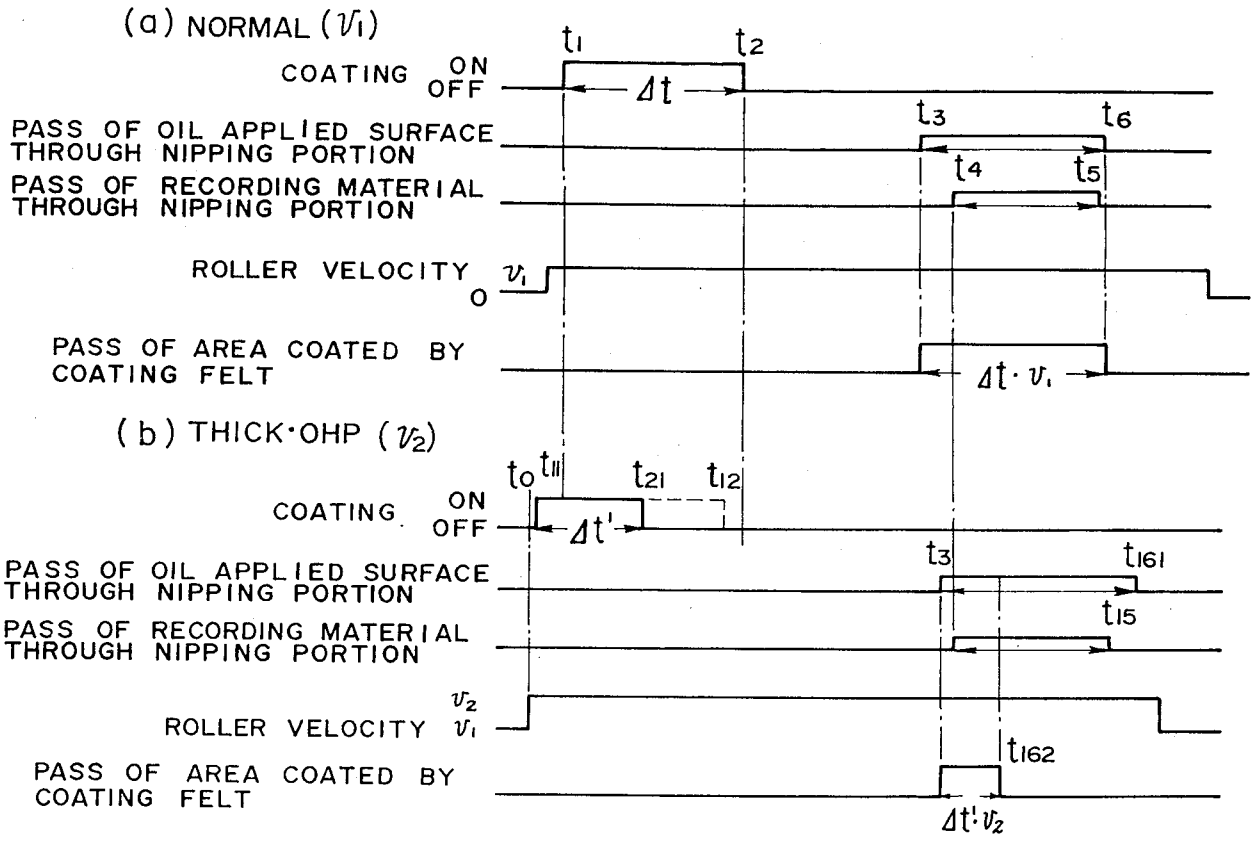

The embodiment shown in FIG. 7 is one for improving the fixing of a color image (of plural colors) by the utilization of the fixing means T shown in FIGS. 1 and 2 and presenting a more effective method of utilizing the parting agent.

As previously described, when application of the silicon oil is effected at the lower second fixing speed, the amount of oil applied generally increases, but when the speed becomes considerably lower, a considerable amount of oil applied is obtained particularly at the start of the application of the oil. However, where the amount of toner forming a color image (of plural colors) or an unfixed image is great, a flow of image is liable to occur due to the great amount of parting agent.

The present embodiment solves this problem and provides an application sequence in which no disturbance of the image or no offset occurs during the fixation of the recording material from its leading end edge to its trailing end edge even at a considerably low fixing speed.

Briefly showing a feature of the present embodiment, it is that the application period of the application member at a low fixing speed is not caused to act on the full length of the recording material as shown in FIGS. 4, 5 and 6 and is made into an application period shorter than the full length with the leading end edge of the recording material as the reference. The parting agent remaining on the surface of the roller is supplied to the surface of the roller which bears against the remainder of the recording material. Accordingly, the application period is determined with the amount of remaining parting agent taken into account, but it is important that a time shorter than the time during which the full length of the recording material is fixed is used as the period of the supply of the parting agent to the roller by the application member.

The chart of FIG. 7 is one in which the feature of the present embodiment is added with the chart of the FIG. 4 embodiment as the basis. The application area by the application felt in the charts (a) and (b) shows the time during which the application felt actually bears against the surface of the roller and the silicon oil in the application range in which the silicon oil is supplied passes through the nip. In the chart (a), if the application period $(t_2-t_1)$ is $\Delta t \cdot V_1$ and this is identical to the passage period $(t_6-t_3)$ of the surface of the roller to which the oil has been applied. In the chart (b), if the application period $(t_{21}-t_{11})$ is $\Delta t'$, it is shorter than $(t_{12}-t_{11})$ in the FIG. 4 embodiment and satisfies $t_3<t_4$, and the application area is $\Delta t' \cdot V_2$ and becomes a period $(t_{162}-t_3)$ shorter than the passage period $(t_{161}-t_3)$ of the surface to which the oil has been applied. During the period $(t_{161}-t_{162})$ thereafter, in the embodiment of FIG. 2, a sufficient amount of silicon oil is supplied by an oil pool 43 accumulated forwardly of the nip between the application roller 3 and the fixing roller 2.

By doing so, the disturbance of the image by too much oil is prevented and efficient utilization of the parting agent and reliable prevention of offset can be achieved.

As described above, the parting agent application sequence is changed with the change of the fixing speed, whereby the surface of the toner image on the recording material is fixed by the surface of the fixing roller always wet with the parting agent and offset of the image can be prevented. Also, at any fixing speed, appropriate values are set as the sequence parameters at the start of the application and the termination of the application, whereby it is possible to apply the parting agent only to the area which is contacted by the recording material, by the surface of the fixing roller, and a maximum effect can be achieved in preventing offset by a minimum necessary amount of applied parting agent. Accordingly, this is not only economical as compared with the prior art, but also can prevent the apparatus from being stained by unnecessary application of the parting agent.

The present invention is particularly effective for color recording apparatuses, and is also applicable to apparatuses which use a variety of recording materials.

The first fixing speed and the second fixing speed are changed in conformity with the recording material, but these speeds may be appropriately changed for the improvement of fixing. For example, in the mode for forming the multi-color toner image, the same key as the designation key for OHP 19 may be used to effect the second fixing speed and, in the case of a monochromatic image, the same key as the designation key for plain paper 20 may be used to effect the first fixing speed.

The application acting period of the present invention is the generic expression of the time during which the application is effected, the point at which the application is started, or the length of the area over which the application is effected, and it is important as the control thereof that the parting agent is reliably applied to the surface of the fixing rotatable member which contacts an unfixed image.

To judge that the recording material has arrived at the position whereat the application is started or stopped, use may be made of a timer, a sensor and a timer, or a plurality of sensors.

What we claim is:

1. An image forming apparatus having:

means for forming an unfixed image on a recording material;

fixing means having a pair of rotatable members for conveying said recording material while holding it between to fix said unfixed image on said recording material;

speed control means for variably controlling the rotational speed of said pair of rotatable members to a first fixing speed and a second fixing speed lower than said first fixing speed;

application means for intermittently supplying a parting agent to at least one of said pair of rotatable members; and application control means for variably controlling the application acting period of said application means in accordance with the rotational speed of said pair of rotatable members variably set by said speed control means.

2. An image forming apparatus according to claim 1, wherein said application control means has application time control means for controlling a second time during which the application action during the fixing at said second fixing speed is effected so that said second time is longer than a first time during which the application action during the fixing at said first fixing speed is effected.

3. An image forming apparatus according to claim 2, wherein the ratio of said second time to said first time is greater than the value of the ratio of said first fixing speed to said second fixing speed.

4. An image forming apparatus according to claim 1, wherein said application control means has application starting time control means for effecting the start of said application acting period at said second fixing speed earlier than the start of said application acting period at said first fixing speed.

5. An image forming apparatus according to claim 4, wherein said application control means has application time control means for controlling a second time during which the application action during the fixing at said second fixing speed is effected so that said second time is longer than a first time during which the application action during the fixing at said first fixing speed is effected.

6. An image forming apparatus according to claim 5, wherein the ratio of said second time to said first time is greater than the value of the ratio of said first fixing speed to said second fixing speed.

7. An image forming apparatus according to claim 1, wherein said speed control means has switching means for varying the rotational speed of said fixing means in accordance with the type of the recording material, and fixing is effected at said second fixing speed when the recording material is of resin or thick, and fixing is effected at said first fixing speed when the recording material is thin.

8. An image forming apparatus according to claim 7, wherein said application control means has application starting time control means for effecting the start of said application acting period at said second fixing speed earlier than the start of said application acting period at said first fixing speed.

9. An image forming apparatus according to claim 8, wherein said application control means has application time control means for controlling a second time during which the application action during the fixing at said second fixing speed is effected so that said second time is longer than a first time during which the application action during the fixing at said first fixing speed is effected.

10. An image forming apparatus having:

means for forming a thermoplastic unfixed image on a recording material;

heating-fixing means having a pair of rotatable members for conveying said recording material while holding it therebetween to fix said unfixed image on said recording material and means for heating at least one of said pair of rotatable members;

speed control means for changing over and controlling the fixing rotational speed of said pair of rotatable members to a first fixing speed or a second fixing speed lower than said first fixinig speed to make the fixing of said unfixed image relative to said recording material appropriate;

application means for intermittently supplying offset preventing liquid to at least one of said rotatable members; and application control means for variable controlling the application acting period of said application means in accordance with the rotational speed of said pair of rotatable members variably set by said speed control means.

11. An image forming apparatus according to claim 10, wherein said speed control means has switching means for varying the rotational speed of said fixing means in accordance with the type of said recording material, and fixation is effected at said second fixing speed when said recording material is of resin or thick, and fixation is effected at said first fixing speed when said recording material is thin.

12. An image forming apparatus according to claim 11, wherein said application control means has application starting time control means for effecting the start of said application acting period at said second fixing speed earlier than the start of said application acting period at said first fixing speed.

13. An image forming apparatus according to claim 12, wherein said application control means has application time control means for controlling a second time during which the application action during the fixing at said second fixing speed is effected so that said second time is longer than a first time during which the application action during the fixing at said first fixing speed is effected.

14. An image forming apparatus according to claim 13, wherein said application means has an applying rotatable member adapted to bear against one of said rotatable members and an application member adapted to be intermittently engaged and disengaged with said applying rotatable member.

15. An image forming apparatus according to claim 10, wherein said forming means has color image forming means capable of forming the unfixed image into a monochromatic or multi-colored image, and said first fixing speed is controlled so as to be used during the fixing of the monochromatic image and said second fixing speed is controlled so as to be used during the fixing of the multi-colored image.

16. An image forming apparatus having:

means for forming an unfixed image on a recording material;

fixing means having a pair of rotatable members for conveying said recording while holding it therebetween to fix said unfixed image on said recording material;

speed control means for variably controlling the rotational speed of said pair of rotatable members to a first fixing speed and a second fixing speed lower than said first fixing speed;

application means for intermittently supplying a parting agent to at least one of said pair of rotatable member; and application control means for variably controlling the point of time at which said application means starts to supply the parting agent to said fixing rotatable members, in accordance with the rotational speed of said pair of rotatable members variably set by said speed control means.

17. An image forming apparatus according to claim 16, wherein said application control means has application area length control means for making the length of the area of the surface of said rotatable members to which said application means applies the parting agent for the same recording material shorter in the mode of said second fixing speed than in the mode of said first fixing speed.

18. An image forming apparatus according to claim 17, wherein said unfixed image is a multi-colored powder image.

19. An image forming apparatus according to claim 17, wherein said application means has a first application member adapted to bear against one of said pair of rotatable members to transmit the parting agent, and a second application member adapted to be engaged and disengaged with said first application member, and the point of time at which the supply of said parting agent is started is the time when said second application member contacts said first application member.

20. An image forming apparatus according to claim 19, wherein said forming means is capable of forming a multi-colored image, and said second fixing speed is selected in a mode wherein the recording material is thick paper or a resin sheet and a multi-colored image is formed on said recording material.

21. An image forming apparatus having:

means for forming an unfixed image on a recording material;

fixing means having a pair of rotatable members for conveying said recording material while holding it therebetween to fix said unfixed image on said recording material;

speed control means for variably controlling the rotational speed of said pair of rotatable members to a first fixing speed and a second fixing speed lower than said first fixing speed;

means for substantially judging the position of said recording material in said apparatus;

application means for intermittently supplying a parting agent to at least one of said pair of rotatable members; and application control means for receiving the signal from said judging means and variably controlling the application acting period of said application means in accordance with the rotational speed of said pair of rotatable members variably set by said speed control means.

22. An image forming apparatus according to claim 21, wherein said judging means is indirect judging means having a counter capable of seeing the movement of said recording material as time.

23. An image forming apparatus according to claim 21, wherein said judging means has means for directly detecting the recording material.

* * * * *

UNITED STATES PATENT AND TRADEMARK OFFICE

CERTIFICATE OF CORRECTION

PATENT NO. : 4,593,992

DATED : June 10, 1986

INVENTOR(S) : KENJI YOSHINAGA, ET AL.

It is certified that error appears in the above-identified patent and that said Letters Patent is hereby corrected as shown below:

Column 2, line 16, after "intermittently" insert --effected was not put into practical use, and the--.

Column 9, line 22, change "$(t_{15} - t_4) - \alpha T_2$" to --$(t_{15} - t_4) \equiv \alpha T_2$--.

Column 10, line 9, change "$t_{31}$ = tll + $T_1$)" to --$t_{31} = t_{11} + T_1$)--.

Column 12, line 66 (Claim 2, line 4), delete "the" (second occurrence).

Column 13, line 1 (Claim 2, line 7), delete "the";

line 16 (Claim 5, line 4), delete "the" (second occurrence);

line 19 (Claim 5, line 7), delete "the";

line 42 (Claim 9, line 4), delete "the" (second occurrence);

line 45 (Claim 9, line 7), delete "the".

line 64 (Claim 10, line 18), change "variable" to --variably--.

Column 14, line 18 (Claim 13, line 4) delete "the" (second occurrence);

line 21 (Claim 13, line 7), delete "the";

UNITED STATES PATENT AND TRADEMARK OFFICE

CERTIFICATE OF CORRECTION

PATENT NO. : 4,593,992

DATED : June 10, 1986

INVENTOR(S) : KENJI YOSHINAGA, ET AL.

It is certified that error appears in the above-identified patent and that said Letters Patent is hereby corrected as shown below:

Column 14, line 33 (Claim 15, line 5) delete "the";
line 35 (Claim 15, line 7) delete "the".

Signed and Sealed this

Twentieth Day of January, 1987

*Attest:*

DONALD J. QUIGG

*Attesting Officer*

*Commissioner of Patents and Trademarks*